US007878960B1

(12) United States Patent
Liu

(10) Patent No.: US 7,878,960 B1
(45) Date of Patent: Feb. 1, 2011

(54) WAISTLINE SLIMMING EXERCISE MACHINE

(76) Inventor: Fen-Ying Liu, No. 27, Dade 3rd St., Taichung County, Dadu Township (TW) 432

( * ) Notice: Subject to any disclaimer, the term of this patent is extended or adjusted under 35 U.S.C. 154(b) by 0 days.

(21) Appl. No.: 12/557,515

(22) Filed: Sep. 10, 2009

(51) Int. Cl.
*A63B 22/14* (2006.01)

(52) U.S. Cl. ..... 482/146; 482/52

(58) Field of Classification Search ..... 482/51, 482/52, 53, 70, 79, 80, 146, 147, 148
See application file for complete search history.

(56) References Cited

U.S. PATENT DOCUMENTS

| | | | | |
|---|---|---|---|---|
| 3,511,500 | A * | 5/1970 | Dunn | 482/113 |
| 5,298,002 | A * | 3/1994 | Lin | 482/53 |
| 5,807,210 | A * | 9/1998 | Devlin | 482/52 |
| 6,042,521 | A * | 3/2000 | De Giorgis | 482/79 |
| 6,595,899 | B2 * | 7/2003 | Liang | 482/53 |
| 6,709,367 | B1 * | 3/2004 | Liang | 482/53 |
| 6,712,739 | B1 * | 3/2004 | Chen | 482/53 |
| 6,889,657 | B2 * | 5/2005 | Ruesseler et al. | 123/446 |
| 6,921,353 | B2 * | 7/2005 | Chuang | 482/52 |
| 6,997,854 | B2 * | 2/2006 | Yang | 482/53 |
| 7,048,675 | B1 * | 5/2006 | Liang | 482/53 |
| 7,137,928 | B1 * | 11/2006 | Chen | 482/53 |
| 7,530,928 | B2 * | 5/2009 | Liao | 482/53 |
| 2003/0008750 | A1 * | 1/2003 | Liang | 482/53 |
| 2004/0097337 | A1 * | 5/2004 | Chuang | 482/52 |
| 2005/0049116 | A1 * | 3/2005 | Huang | 482/51 |

* cited by examiner

*Primary Examiner*—Nicholas D Lucchesi
*Assistant Examiner*—Tam Nguyen

(57) ABSTRACT

A waistline slimming exercise machine having an upper center connecting member, two swing arms of a swing mechanism attached to a through aperture of a base with a combining aperture on an upper center connecting member, a securing end of a shock absorber and a first assembly end of a first linkage member are screwed to a respective locking aperture on a side of the base adjacent an internal assembly space of the base, a pivoting end of each swing arm is assembled onto a first aperture of a balancing base, a first pivoting end of the first linkage member is assembled onto a connecting aperture of the balancing base, the swing mechanism further including a pair of second linkage members, each connected to a driving element having a first connecting end that is attached to a pedal such that movement of the first linkage member and the driving element of the second linkage member causes the pedal to rotate about a vertical axis when the pedals are moved up and down.

17 Claims, 16 Drawing Sheets

WAISTLINE SLIMMING EXERCISE MACHINE

BACKGROUND OF THE INVENTION

1. Field of the Invention

The present invention relates to a waistline slimming exercise machine, and more particularly to a waistline slimming exercise machine in which the swing mechanism moves vertically, and the two swing arms have an offset between each other and drive a linkage member so that the driving element causes the pedal to simultaneously swing left and right so that the user performs not just a stepping exercise but also a waist twisting exercise from the two different movements provided by the pedals.

2. Description of the Related Art

Currently, most indoor exercise machines simulate outdoor exercise movements, permitting users to achieve the same exercise effects in a limited indoor space. For example, stepping machines allows the user to step on pedals alternatively to simulate a walking exercise.

A typical stepping machine, as shown in FIG. 16, has two pedals 40 pivoted onto a base 41, and a linkage mechanism connects together the two pedals 40 and a hydraulic cylinder 42. The damping effect provided by the hydraulic cylinder 42 causes the pedal 40 to be lifted alternatively and maintains synchronization between the two pedals 40, while the damping force provided by the hydraulic cylinder 42 to the pedals 40 makes work for the user to provide exercise.

However, the prior art stepping machine can only provide exercise movements for legs, and the other parts of the body do not benefit from the machine. Another small exercise machine provides a horizontal rotating plate on the base which allows users to twist their body below the waistline left and right repeatedly. Then again, this type of exercise machine can only provide exercise movements for the waistline, while the other parts of body similarly do not benefit from the machine.

Therefore, it is desirable to provide a waistline slimming exercise machine to mitigate and/or obviate the aforementioned problems.

SUMMARY OF THE INVENTION

An objective of the present invention is to provide a waistline slimming exercise machine in which the swing mechanism moves vertically, and the two swing arms have an offset between each other and drive a linkage member so that the driving element causes the pedals to simultaneously swing left and right so that the user performs not just a stepping exercise but also a waist twisting exercise from the two different movements provided by the pedals In order to achieve the above-mentioned objective, a waistline slimming exercise machine comprises: a base, a swing mechanism and a peddle element. The base at its center position has a lower center connecting member with an internal assembly space and a through aperture and a locking aperture on two side walls, and a stop disposed at two shorter sides of the base. The swing mechanism comprises a upper center connecting member and an inclining swing arm disposed on two sides of the upper center connecting member, and an assembly end disposed at the bottom of the upper end of the swing arm and combined with a shock absorber, and another end of the shock absorber having a securing end. The swing arm is capable of being combined with a first linkage member, and the first linkage member has a first pivoting end on its upper end and a first assembly end on another end. The swing mechanism further has a second linkage member, one end of the second linkage member attached with a driving element, the driving element has a push-pull bar, a first connecting end and a second connecting end.

The peddle element is capable of being combined with the swing mechanism and comprising a balance base and a peddle. The balance base has a pivoting space on its bottom and a first aperture and a connecting aperture on two side walls for a securing and a protrusion hole at a center position of its upper face. The peddle has a rotating plate on its bottom face and a pivot axle aligned with the protrusion hole at its center position, and the peddle has an assembly aperture;

The upper center connecting member and the two swing arms of the swing mechanism are attached to the through aperture of the internal assembly space of the base with a combining aperture on the upper center connecting member, and the securing end and the first assembly end of the shock absorbers of the two swing arms and the first linkage member are screwed to the locking aperture on two sides of the internal assembly space of the base; a second pivoting end of the swing arm is assembled onto the first aperture of the pivoting space of the balance base; the first pivoting end of the first linkage member is assembled onto the tapped aperture of the pivoting space of the balance base; the swing mechanism further including the second linkage member, the driving element at the other end of the second linkage member utilizing the first connecting end for attachment to the peddle; and with the movement of the first linkage member, the driving element of the second linkage member causes the peddle rotate about a vertical axis.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
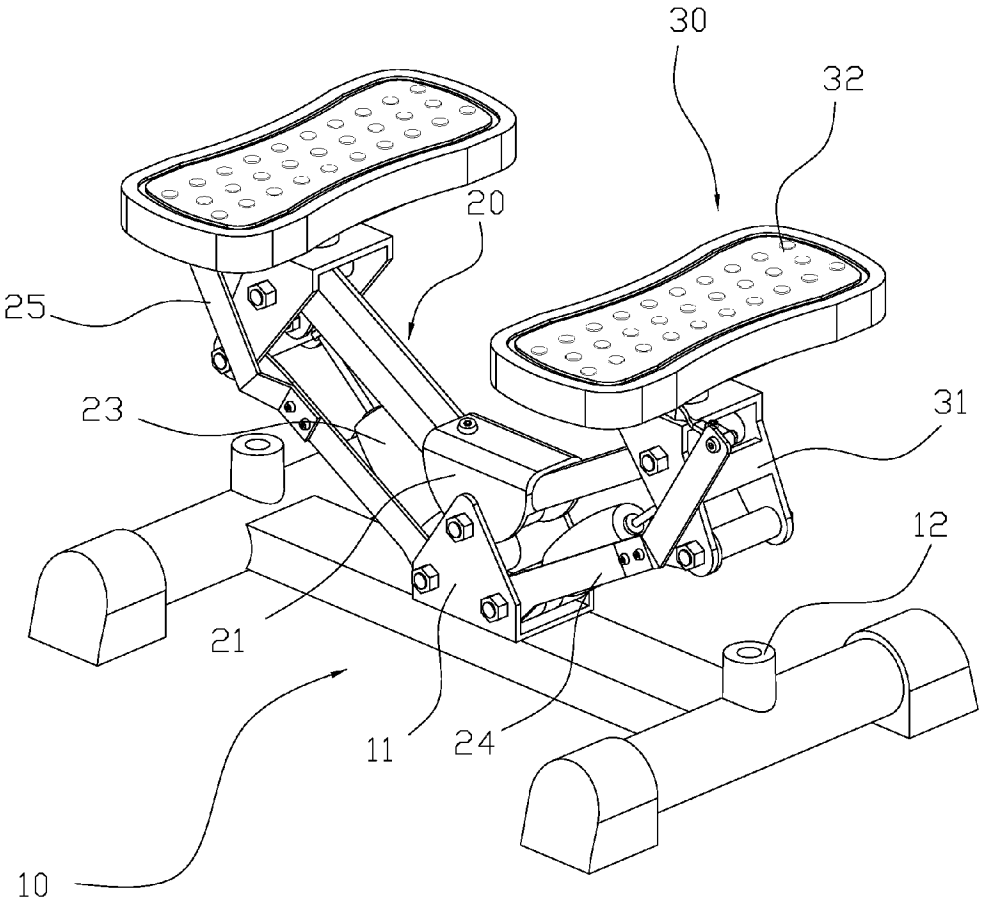
FIG. 1 is a perspective view of the present invention.
Figure 2:
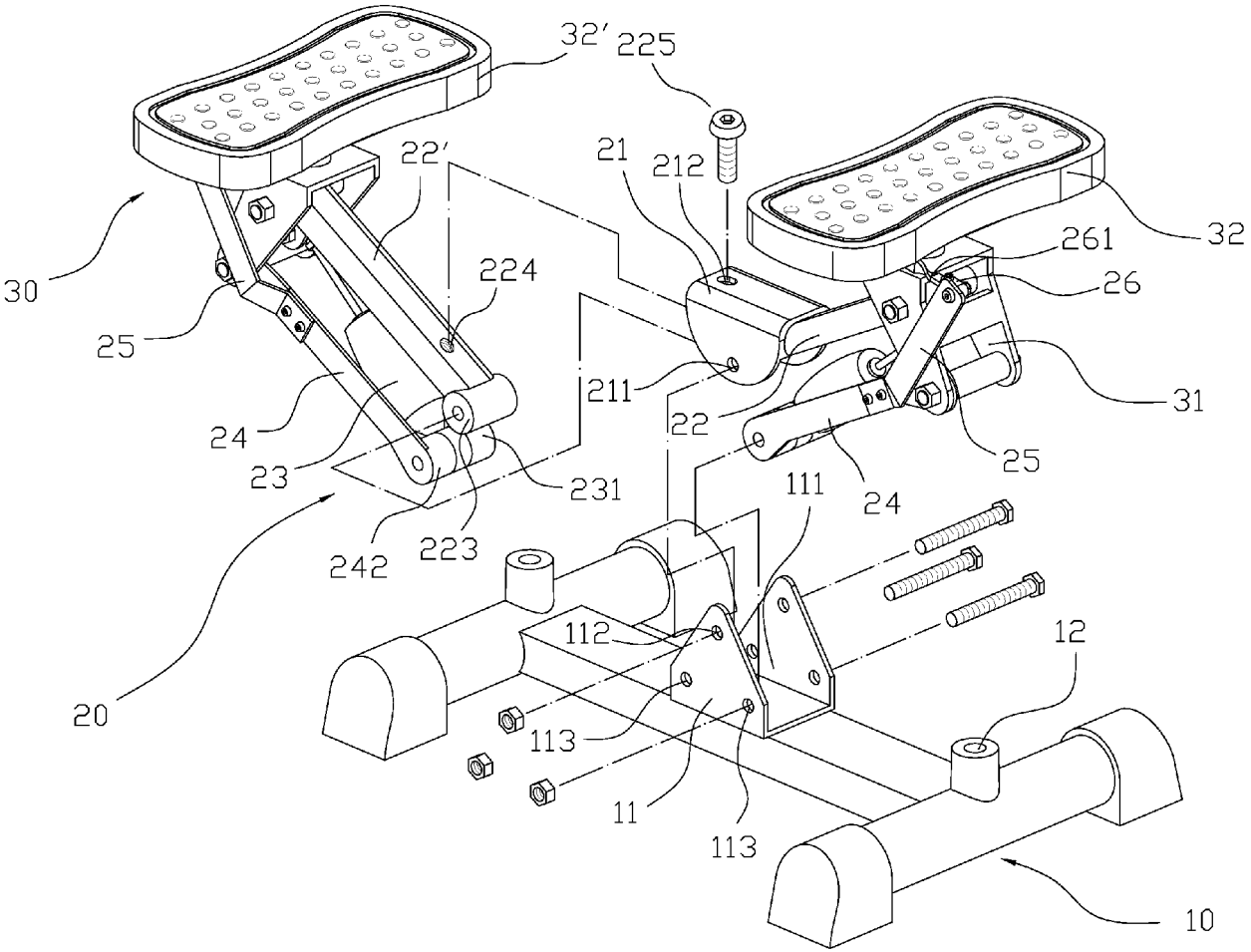
FIG. 2 is a perspective exploded view of the present invention.
Figure 3:
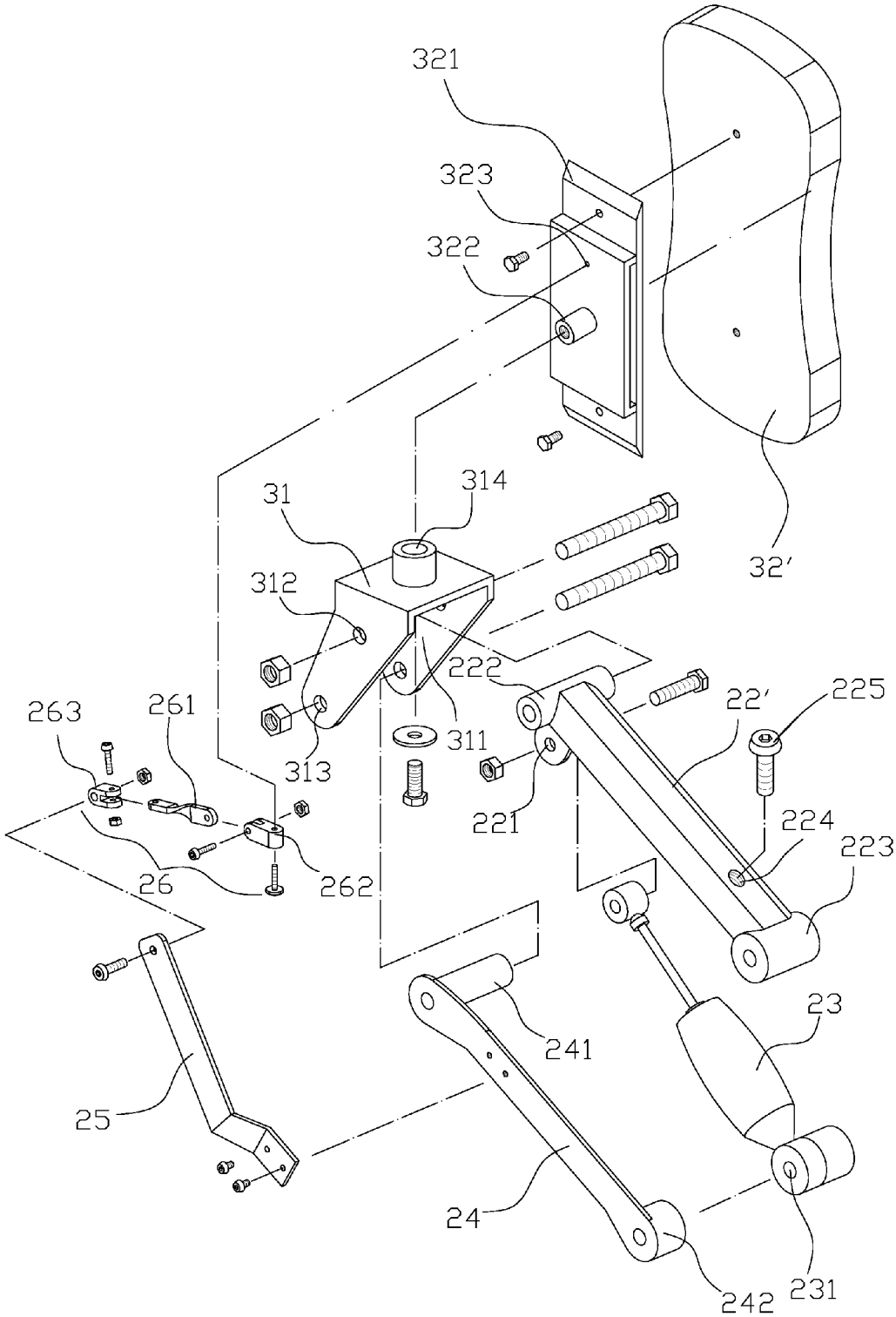
FIG. 3 is a perspective exploded view of a peddle element and a swing mechanism according to the present invention.
Figure 4:
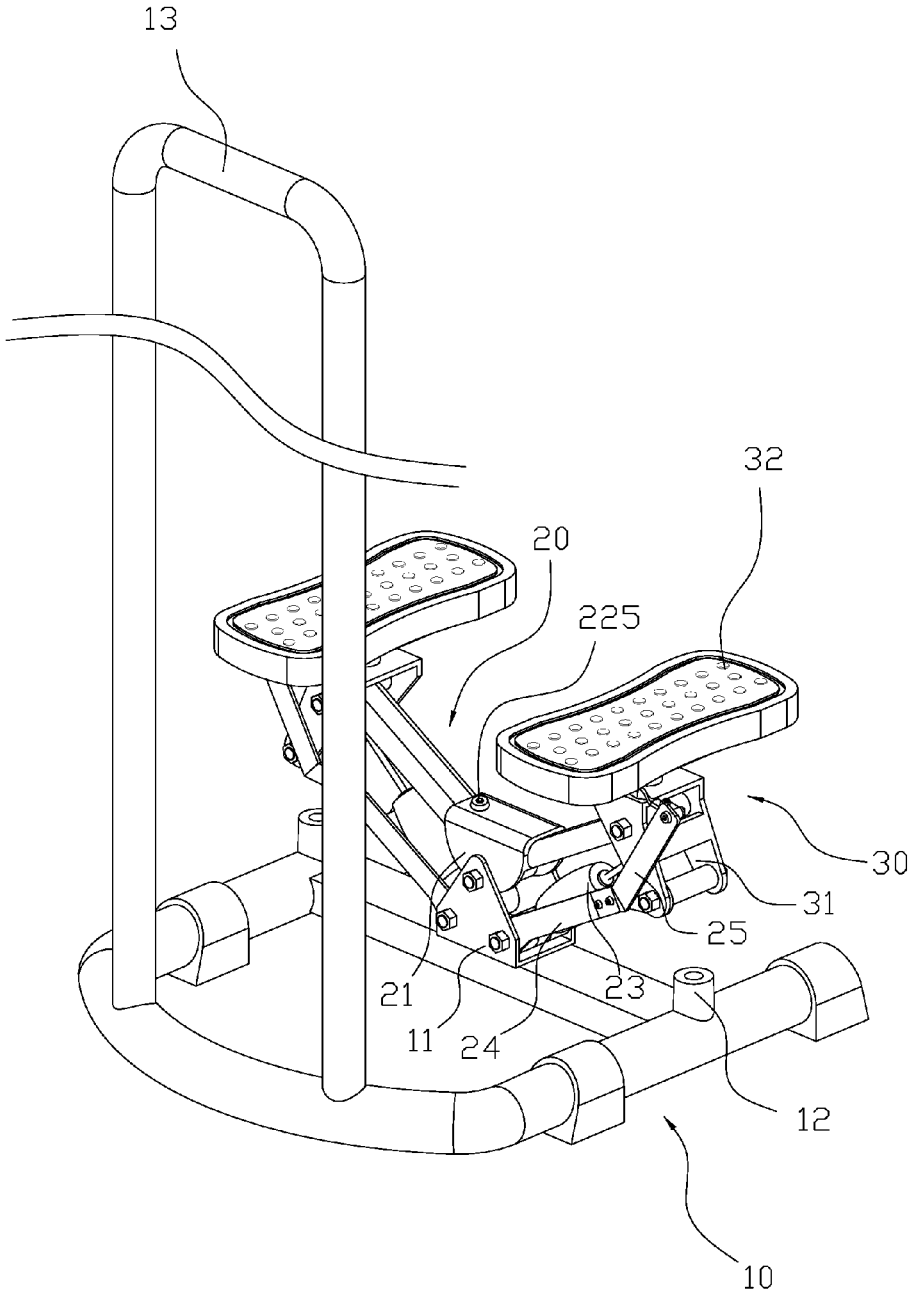
FIG. 4 is a perspective view of another embodiment of the present invention.
Figure 5:
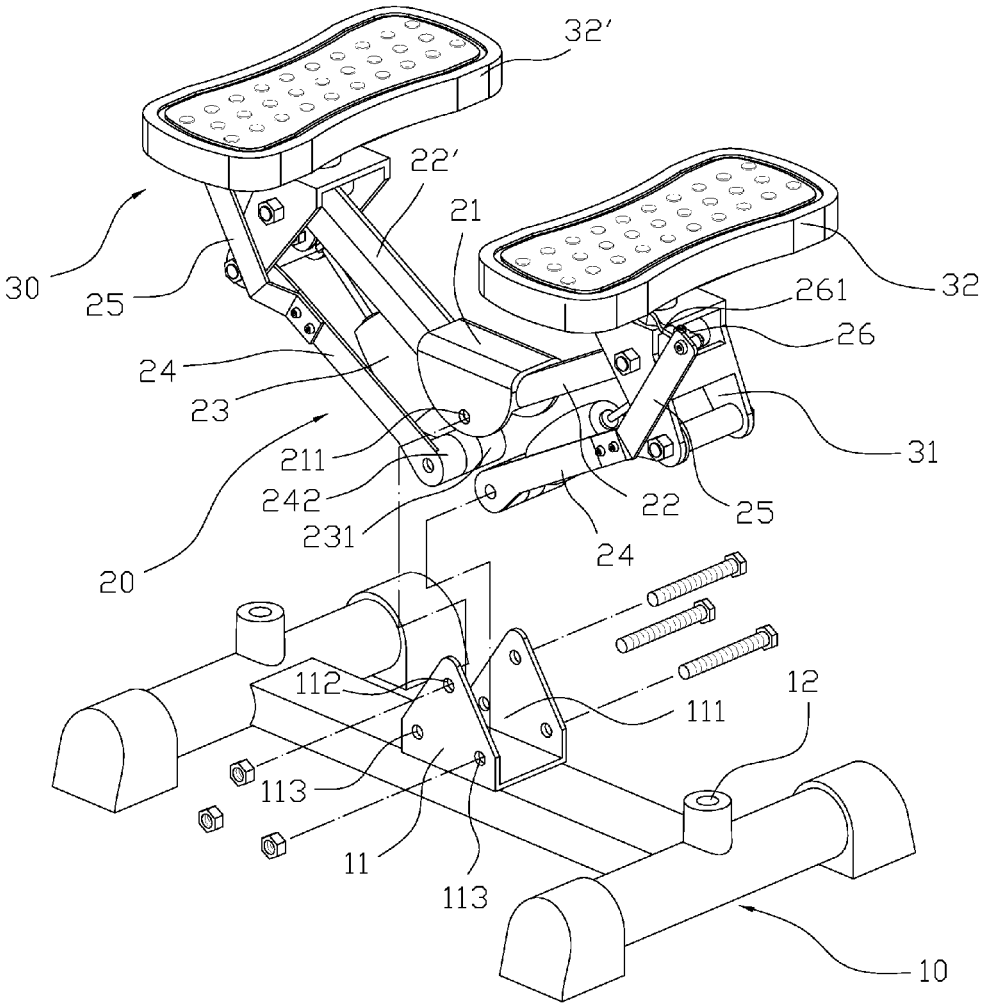
FIG. 5 is a perspective view of another embodiment according to the present invention.
Figure 6:
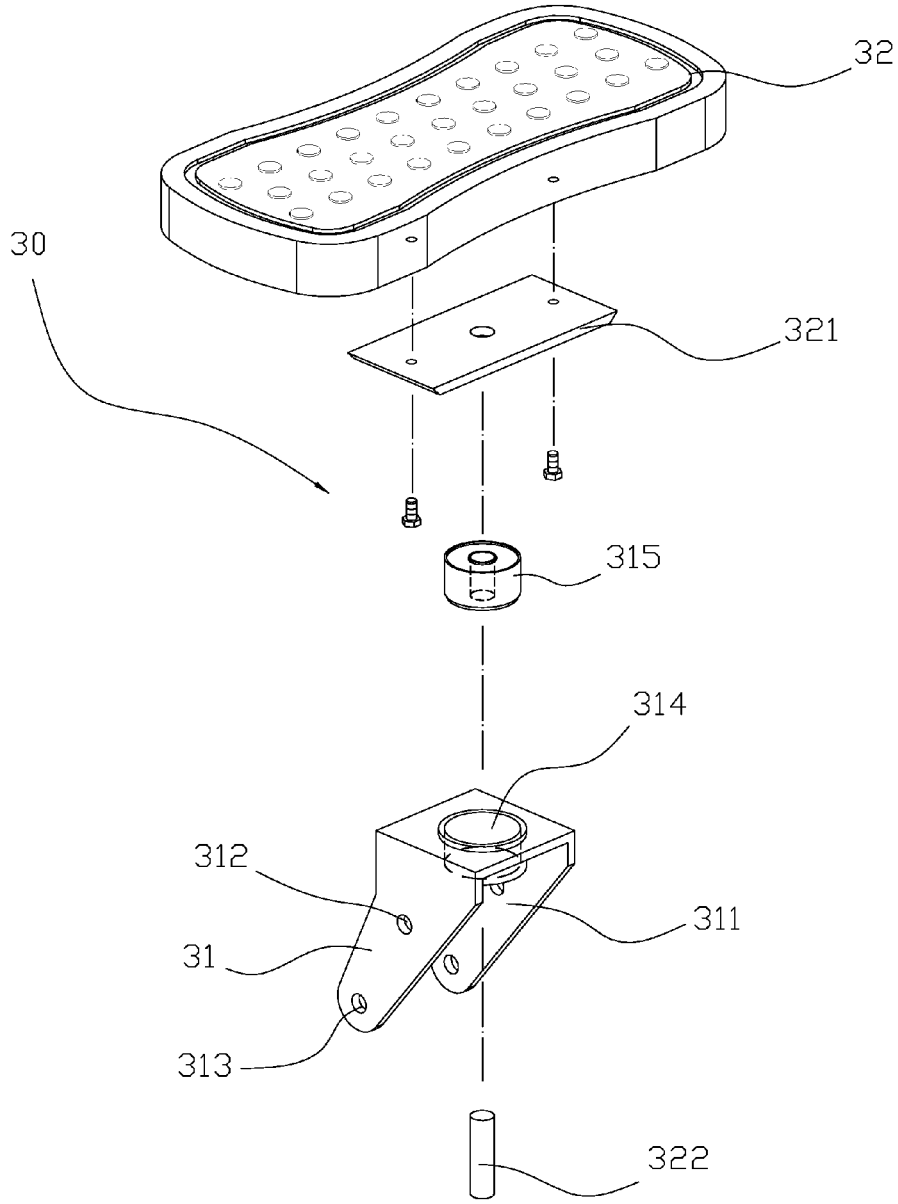
FIG. 6 is a perspective exploded view of a peddle element of another embodiment according to the present invention.

First, please refer to FIGS. 1, 2 and 3. A waistline slimming exercise machine comprises: a base 10, a swing mechanism 20 and a peddle element 30. The base 10 is an H-shaped frame, and a lower center connecting member 11 with a U shape is disposed at the center of its central beam, and an internal assembly space 111 is formed inside connecting member 11 and a through aperture 112 and a locking aperture 113 are located on the two side walls of connecting member 11. A stop 12 is disposed and screwed onto two sides of the base 10 that are shorter in length than the central beam, and the stop 12 is adjustable in height by way of screws. The base 10 has an extended handle 13 at a predetermined position, as shown in FIG. 4. A swing mechanism 20 comprises a upper center connecting member 21 and inclining swing arms 22, 22' disposed on two sides of the upper center connecting member 21. The swing arms 22, 22' couple to respective shock absorbers 23, and to a first linkage member 24 and a second linkage member 25. The upper center connecting member 21 has a slot at its bottom, a combining apertures 211 on two side respective walls and a first aperture 212 on its top surface. An assembly end 221 is disposed respectively on the bottom of the upper end of the swing arms 22, 22' and combines with the shock absorbers 23, and the other end of each shock absorber 23 includes a securing end 231. Each swing arm 22, 22' has a second pivoting end 222 at its upper end. The swing arm 22' has a connecting end 223 for securing the combining aperture 211 of the upper center connecting member 21 and a tapped aperture 224 on its top surface. The tapped aperture 224 is secured to the first aperture 212 of the upper center connecting member 21 by way of a screw 225. Therefore, the upper center connecting member 21 of the swing mechanism 20 and the swing arm 22' can be separated to provide for a smaller storage space. However, the swing arms 22, 22' can also be directly attached to the upper center connecting member 21 (as shown in FIG. 5). The first linkage member 24 has a first pivoting end 241 on its upper end and a first assembly end 242 on another end. The swing mechanism 20 further has a second linkage member 25; one end of the second linkage member 25 is attached by way of a driving element 26, and the driving element 26 includes a push-pull bar 261, a first connecting end 262 and a second connecting end 263. The first connecting end 262 and the second connecting end 263 provide a universal joint or a universal bearing. The peddle element 30 is capable of being combined with the swing mechanism 20, and it comprises a balance base 31 and a peddle 32. The balance base 31 has a pivoting space 311 on its bottom, a first aperture 312 and a connecting aperture 313 on two side walls for securing purposes, and a protrusion hole 314 at a center position of its upper face. The peddle 32 has a rotating plate 321 on its bottom face and a pivot axle 322 aligned with the protrusion hole 314 at its center position, and the peddle 32 or the rotating plate 321 has an assembly aperture 323 at a predetermined position. Alternatively, as shown in FIG. 6, another combination of the balance base 31 and the peddle 32 includes an opened indentation hole 314 that is located at the center position of the balance base 31 and paired with a bearing 315, and the rotating plate 321 of the peddle 32 is combined with the bearing 315 of the balance base 31 with the pivot axle 322.

Figure 7:
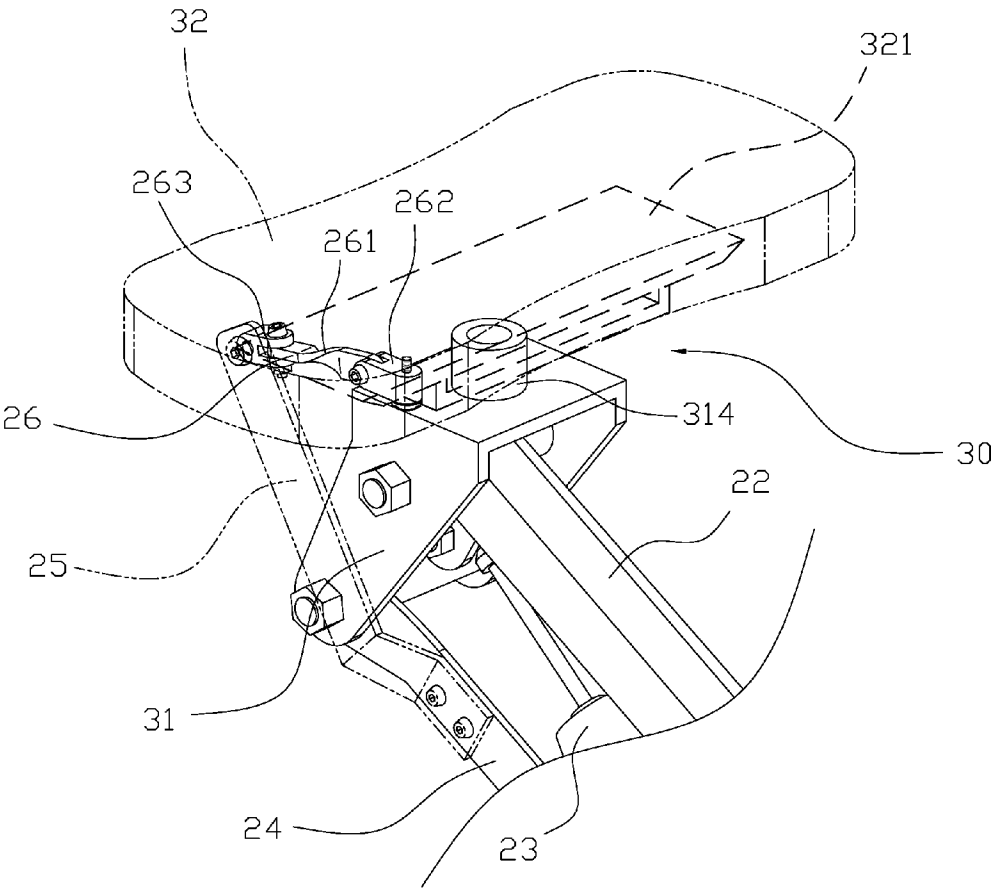
FIG. 7 is a detailed view of a swing mechanism and peddle element according to the present invention.

For further views of the assembly structure please refer to FIGS. 2, 3 and 7. The swing mechanism 20 utilizes the upper center connecting member 21 to connect together the two swing arms 22, 22' and to attach to the through aperture 112 of the internal assembly space 111 of the base 10 by way of the combining aperture 211. The shock absorbers 23 and the first linkage members 24 of the swing arms 22, 22' respectively utilize the securing end 231 and the first assembly end 242 for screwing onto the locking aperture 113 of the internal assembly space 111 of the base 10, and the second pivoting ends 222 of the swing arms 22, 22' are respectively secured to the first apertures 312 of the pivoting spaces 311 of the balance bases 31. The first pivoting end 241 of the first linkage member 24 is secured to the pivoting space 311 of the balance base 31 and screwed to the connecting aperture 313 of the pivoting space 311. Furthermore, the second linkage member 25 can be attached onto the first linkage member 24 of the swing mechanism 20 or any suitable position on the swing mechanism 20 such as on the swing arm 22 or the shock absorber 23. The driving element 26 at one end of the second linkage member 25 utilizes the first connecting end 262 for securing to the assembly aperture 323 on the peddle 32 or the rotating plate 321. Therefore, when the second linkage member 25 moves vertically with the swing arm 22, the driving element 26 causes the peddle 32 to rotate with a biased movement.

Figure 8:
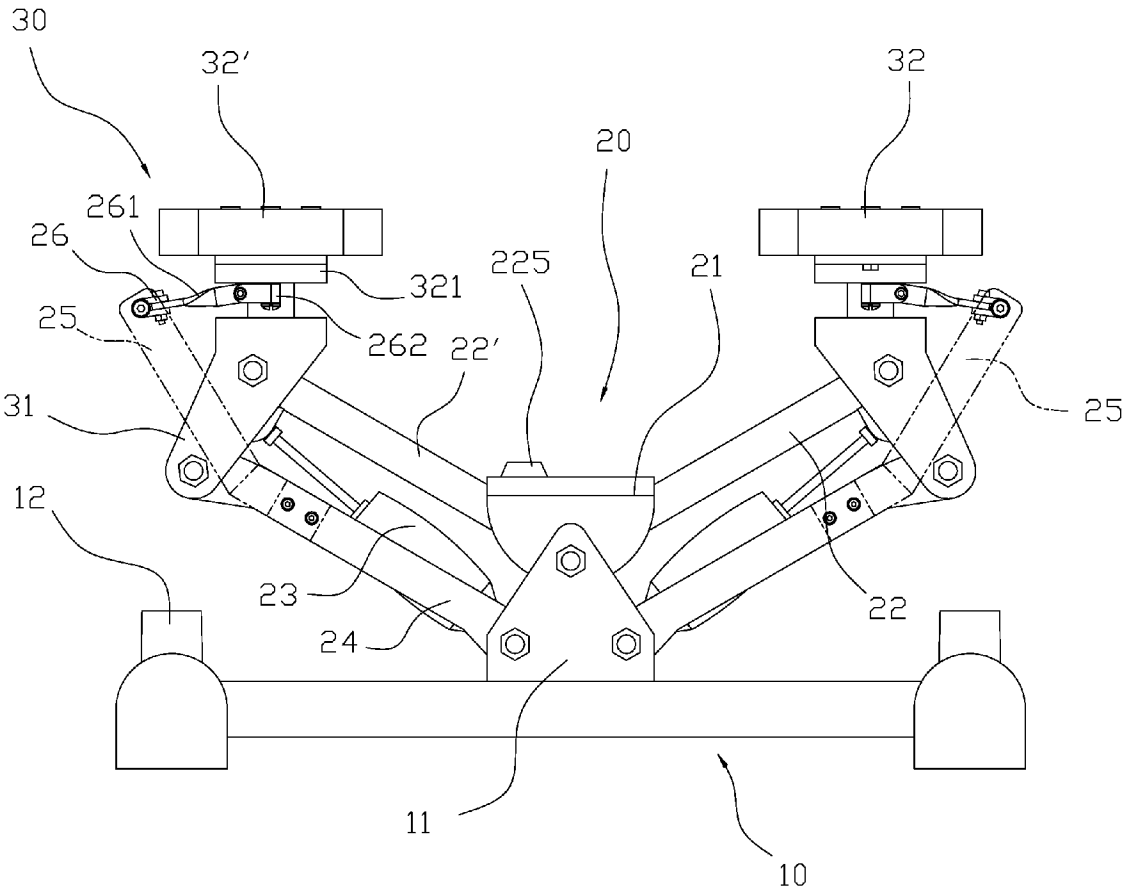
FIG. 8 is a side view of the present invention.
Figure 9:
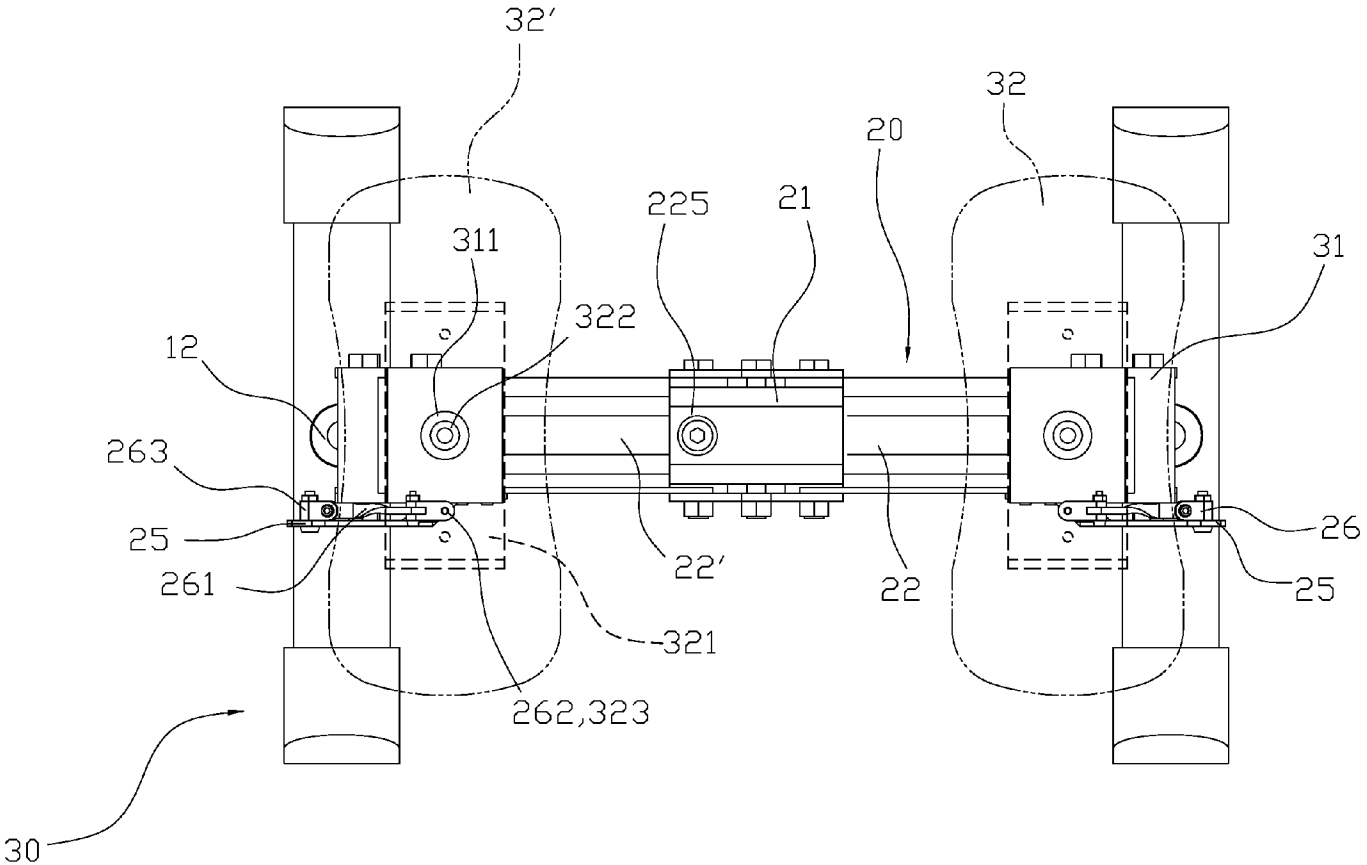
FIG. 9 is a top view of the present invention.
Figure 10:
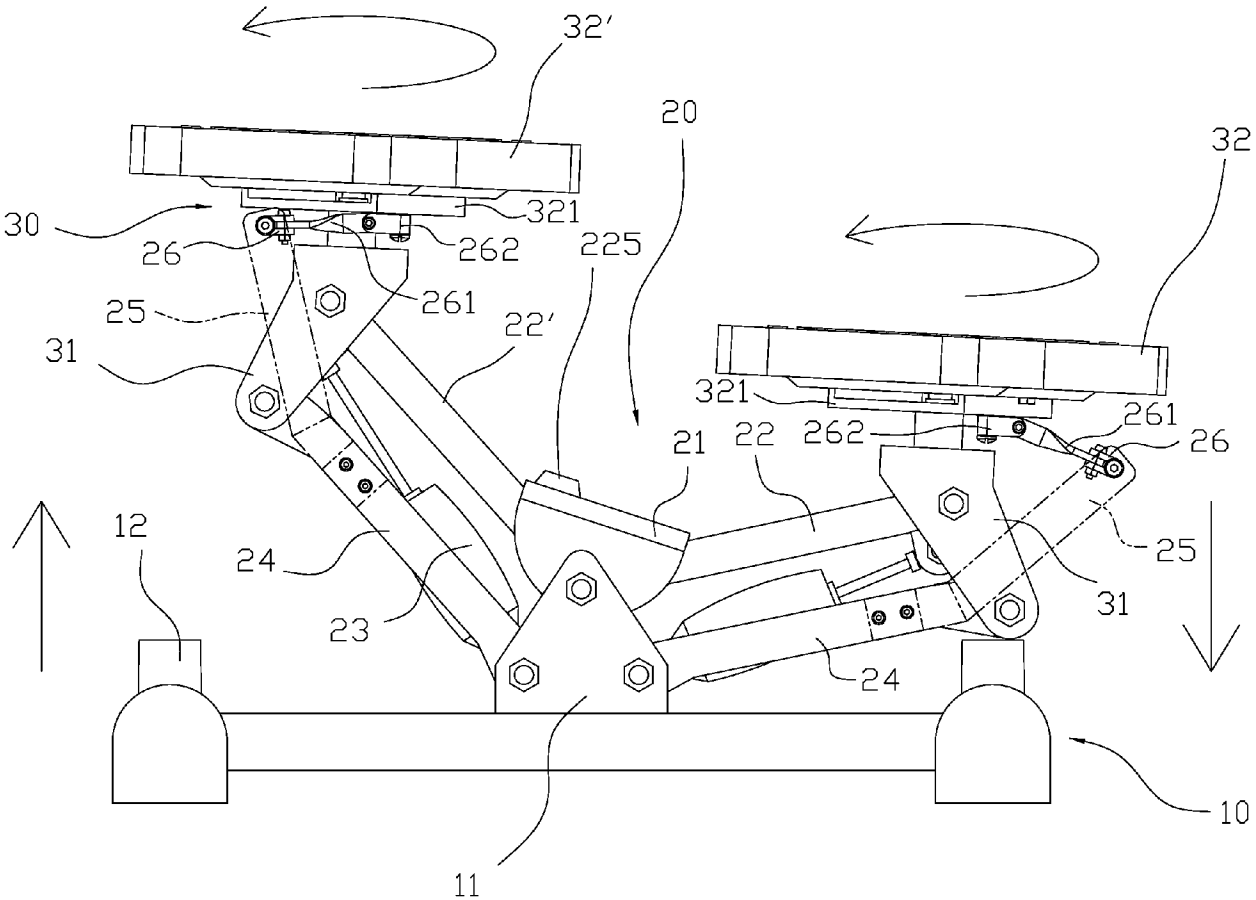
FIG. 10 shows pedals rotating in a clockwise direction according to the present invention.
Figure 11:
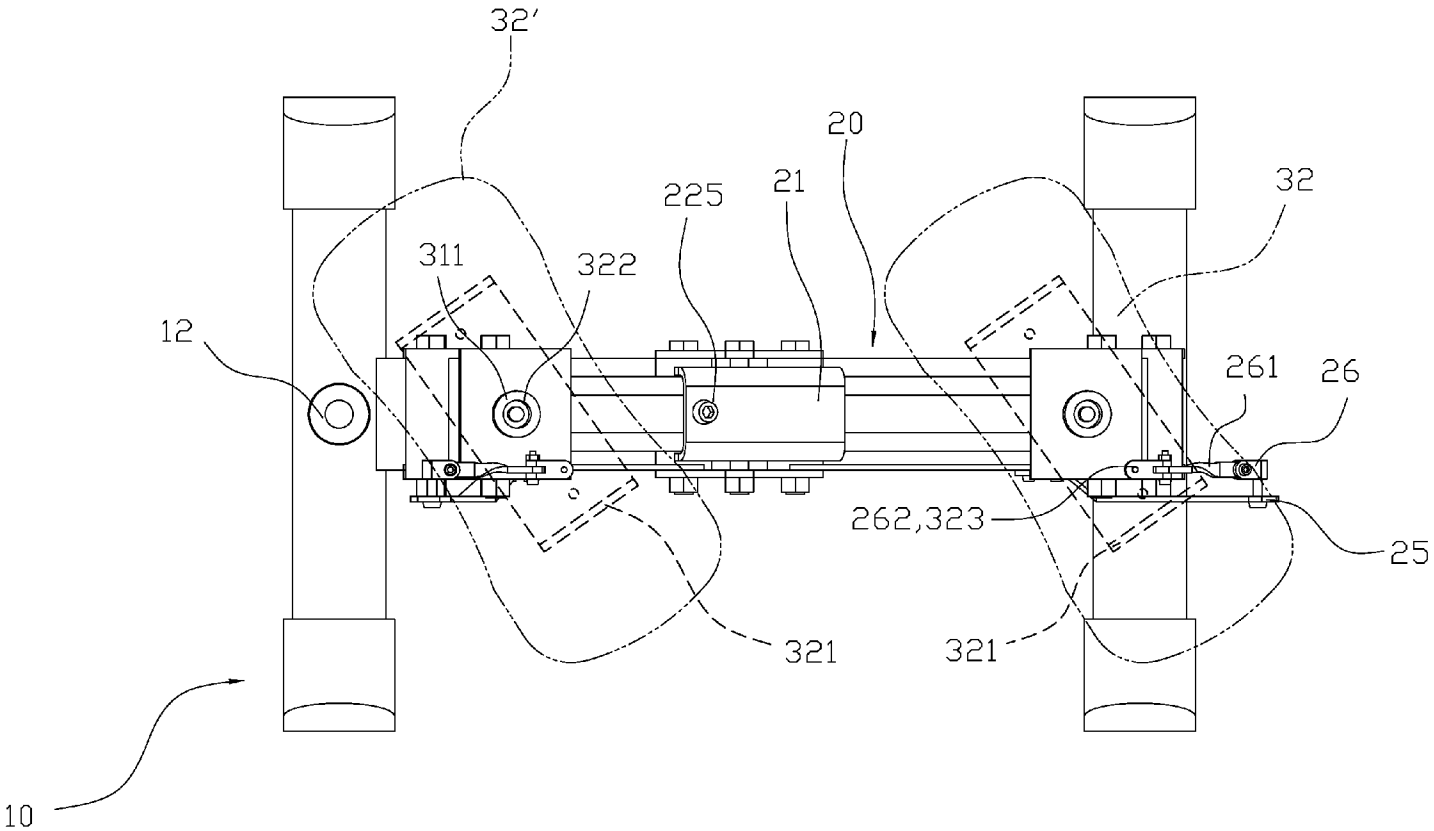
FIG. 11 is a top view showing pedal rotating in a counter-clockwise direction according to the present invention.
Figure 12:
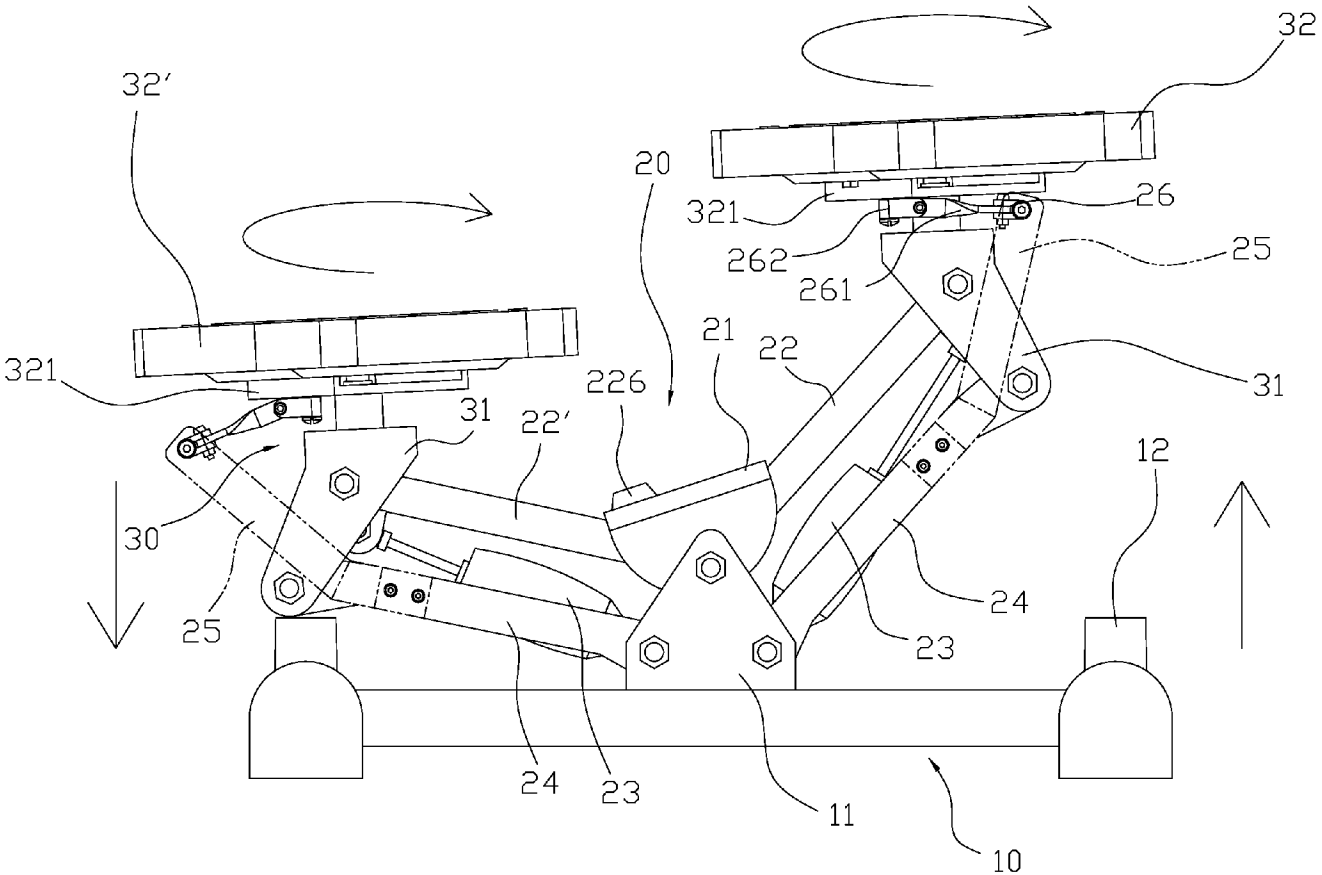
FIG. 12 shows pedal rotating in a counter-clockwise direction according to the present invention.
Figure 13:
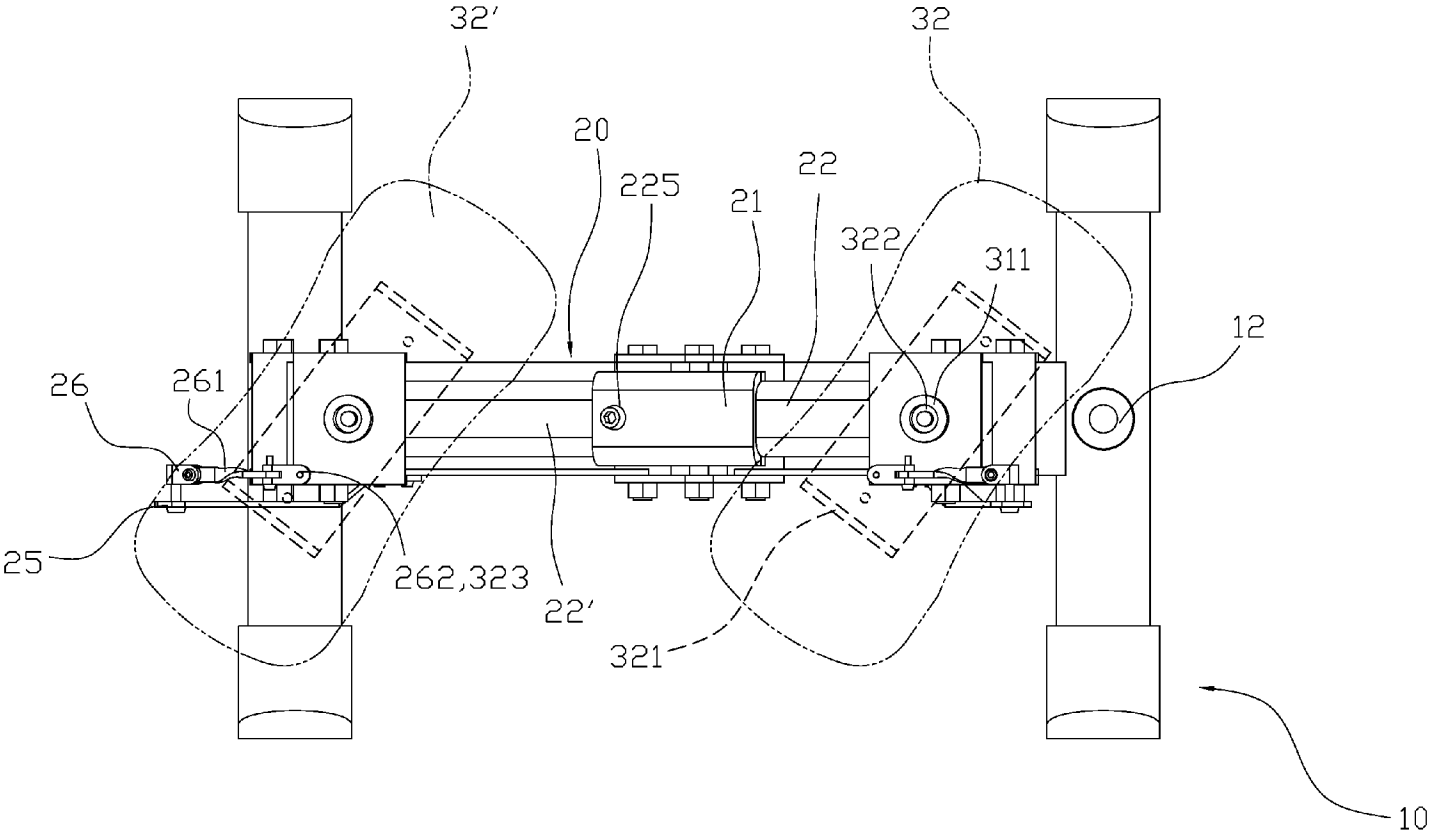
FIG. 13 is a top view of another embodiment of the present invention.

For operation of the device please refer to FIG. 8 and FIG. 9. The swing mechanism 20 utilizes the upper center connecting member 21 for attachment to the through aperture 112 of the lower center connecting member 11 of the base 10, and the securing end 231 of the shock absorber 23 and the first assembly end 242 of the first linkage member 24 are screwed onto the locking aperture 113 so that the swing mechanism 20 and the lower center connecting member 11 form an inclined angle. The second pivoting end 222 of the swing arm 22 and the first pivoting end 241 of the first linkage member 24 are respectively attached to the first aperture 312 and the connecting aperture 313 of the balance base 31 so that the swing arm 22, the first linkage member 24, the lower center connecting member 11 and the balance base 31 form a four-way linkage mechanism that allows the peddle 32 to generate vertical movement. The first linkage member 24 of the swing mechanism 20 has the second linkage member 25, and the driving element 26 at another end of the second linkage member 25 utilizes the first connecting end 262 for securing to the peddle 32 or the assembly aperture 323 of the rotating plate 321. Therefore, when a user uses the exercise machine and causes the swing mechanism 20 to move vertically, the swing arm 22 and the first linkage member 24 have an offset between each other due to the four-way linkage mechanism. When the peddle 32 is pressed down, as shown in FIG. 10, the second linkage member 25 secured onto the first linkage member 24 is driven to move down, and the driving element 26 at the other end of the second linkage member 25 generates a pulling force. With the mechanical relationship established between the push-pull bar 261 and the first connecting end 262, the pulling force is transformed into a horizontal rotating force at the first connecting end 262 and so the assembly aperture 323 of the peddle 32 is pulled away from the pivot axle 322. Moreover, when the other peddle 32' is driven to move upward, the first linkage member 24 moves upward and drives the second linkage member 25 to rotate counter-clockwise so that the driving element 26 at the other end of the second linkage member 25 generates an inward pushing force. With the push-pull bar 261 and the first connecting end 262, the inward pushing force is transformed into a horizontal rotating force at the first connecting end 262 which causes the assembly aperture 323 of the peddle 32' to rotate inward from the pivot axle 322 so that the pedal 32, 32' simultaneously rotate counter-clockwise, as shown in FIG. 11. When the user steps on the peddle 32', as shown in FIG. 12, the first linkage member 24 on the swing arm 22' is pulled down, and so the second linkage member 25 of the first linkage member 24 moves downward, which causes the driving element 26 at the other end of the first linkage member 24 to generate an outward pulling force. With the mechanical relationship between the push-pull bar 261 and the first connecting end 262, the pulling force is transformed into a horizontal rotating force at the first connecting end 262, and so the assembly aperture 323 of the peddle 32' rotates away from the pivot axle 322. The other peddle 32 is driven to move upward; the first linkage member 24 and the second linkage member 25 are driven to move upward, which causes the second linkage member 25 to generate an inward pushing force. With the mechanical relationship between the push-pull bar 261 and the first connecting end 262, the inward pushing force is transformed into a horizontal rotating force at the first connecting end 262, which causes the assembly aperture 323 of the peddle 32 to rotate inward from the pivot axle 322 so that the pedal 32, 32' simultaneously rotate clockwise, as shown in FIG. 13. With the above-mentioned structure, when the user does stepping exercises on the machine, he or she is doing not just stepping exercises but also waist twisting exercises.

Figure 14:
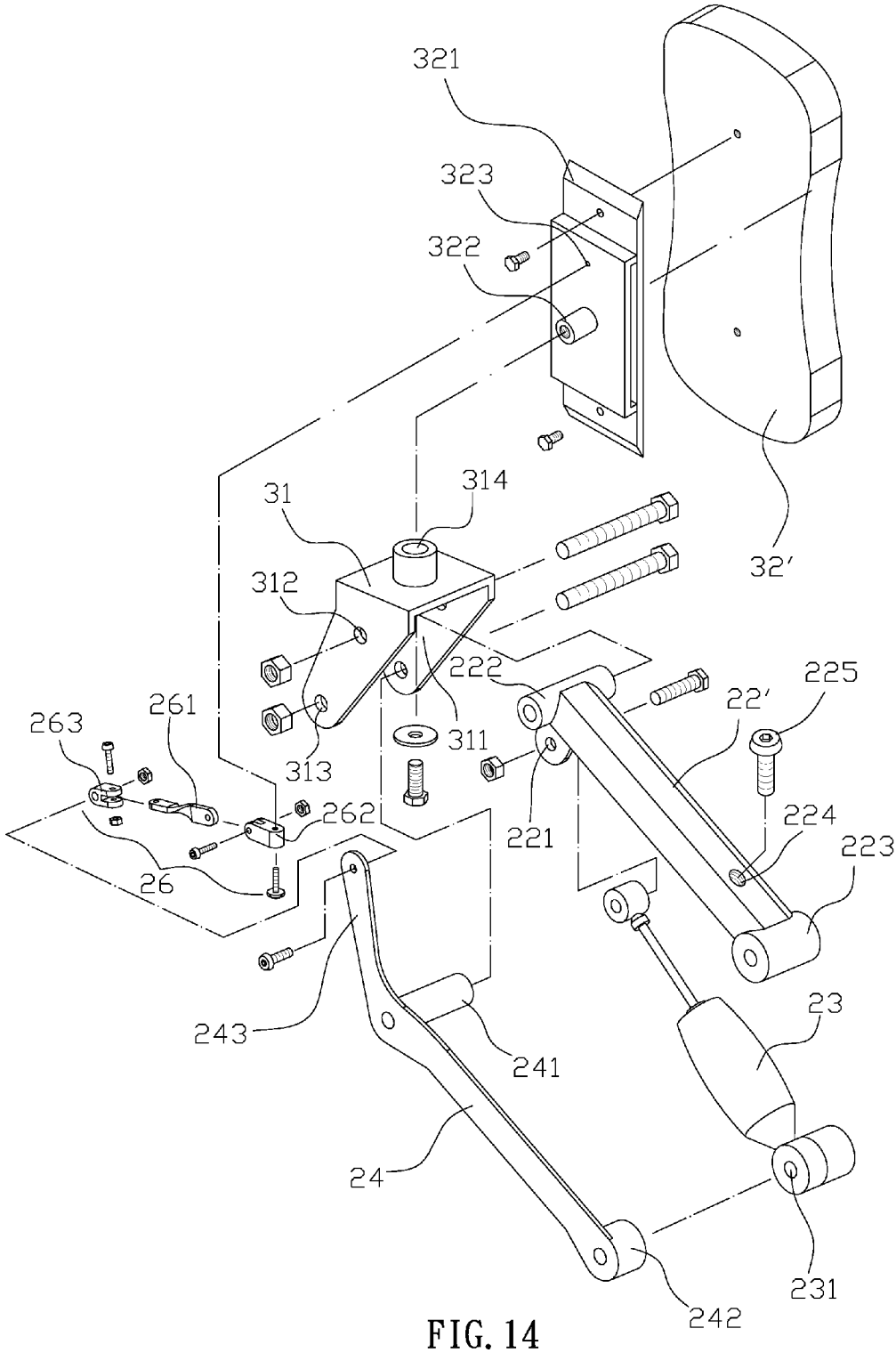
FIG. 14 is a perspective exploded view of a peddle element and swing mechanism in another embodiment according to the present invention.
Figure 15:
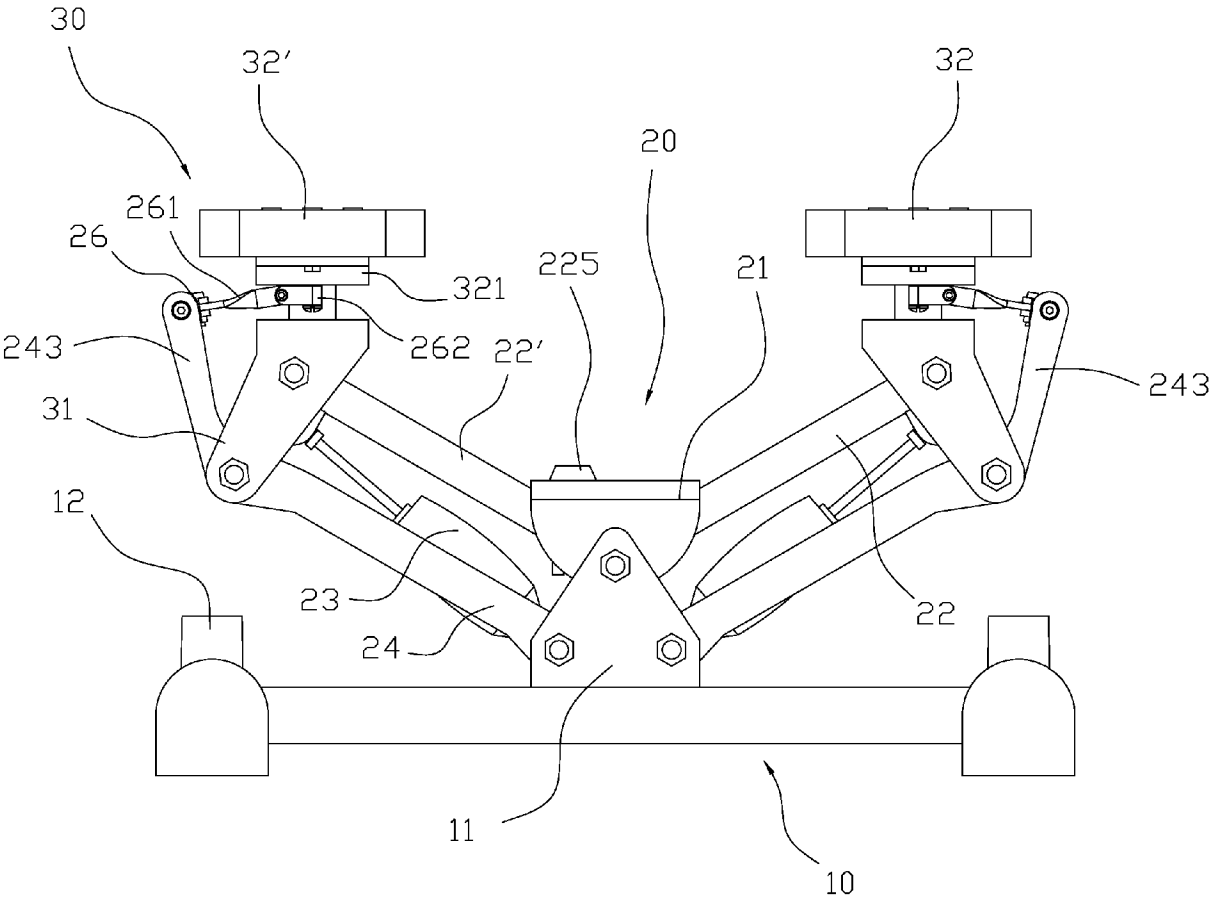
FIG. 15 is a side view of another embodiment of the present invention.
Figure 16:
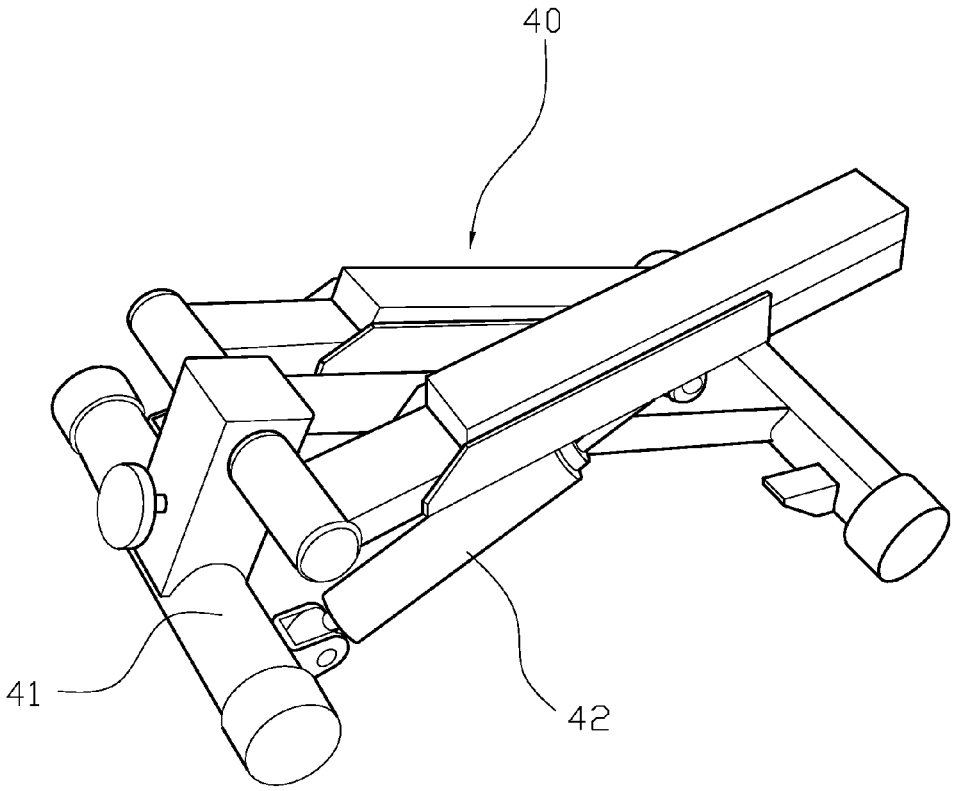
FIG. 16 PRIOR ART
FIG. 16 is a perspective view of a prior art device.

Please refer to FIG. 14 and FIG. 15. In another embodiment of the present invention, the swing mechanism 20 comprises a upper center connecting member 21 and inclining swing arms 22, 22' are disposed on two sides of the upper center connecting member 21. The swing arms 22, 22' are combined with shock absorbers 23 and first linkage members 24. The upper center connecting member 21 has a slot at its bottom, a combining apertures 211 on its two side walls and a first aperture 212 on its top surface. An assembly end 221 is disposed at the bottom of the upper end of the swing arms 22, 22' and couples with the shock absorbers 23, while each other end of the shock absorbers 23 has a securing end 231. The swing arms 22, 22' have a second pivoting end 222 at their upper ends. The swing arm 22' has a connecting end 223 for securing to the combining aperture 211 of the upper center connecting member 21 and a tapped aperture 224 on its top surface. The tapped aperture 224 is secured to the first aperture 212 of the upper center connecting member 21 with a screw 225. The first linkage member 24 has a first pivoting end 241 on its upper end and a first assembly end 242 on another end. The swing mechanism 20 further has an extended driving arm 243; one end of the driving arm 243 is attached with a driving element 26, and the driving element 26 has a push-pull bar 261, a first connecting end 262 and a second connecting end 263. After the swing mechanism 20 and the base 31 of the peddle element 30 are assembled, the extended driving arm 243 of the first linkage member 24 also has the driving element 26, and the other end of the driving element 26 utilizes the first connecting end for attachment to the peddle 32 or the rotating plate 321. With the movement of the first linkage member 24, the driving element 26 of the driving arm 243 causes the peddle 32 to rotate with a biased movement With the above-mentioned structures in the embodiments, the present invention has the following benefits: in the waistline slimming exercise machine, the swing mechanism 20 has two second linkage members 25; when a user uses the exercise machine to cause the swing mechanism 20 to move vertically, the second linkage member 25 moves vertically with the swing arm 22, and the driving element 26 causes the peddle 32 to rotate with a biased movement. Therefore, when the user does stepping exercises on the machine, he or she is doing not just stepping exercises but also waist twisting exercises with the two different movements provide by the pedals 32.

Although the present invention has been explained in relation to its preferred embodiment, it is to be understood that many other possible modifications and variations can be made without departing from the spirit and scope of the invention as hereinafter claimed.

What is claimed is:

1. A waistline slimming exercise machine comprising: a base, a swing mechanism and a pair of pedal elements, wherein:

the base at its center position having a lower center connecting member with an internal assembly space, a through aperture and a locking aperture on two side walls, and the base further having a stop disposed at two shorter sides of the base;

the swing mechanism comprising an upper center connecting member and an inclining swing arm disposed on two sides of the upper center connecting member, each swing arm having an assembly end disposed at the bottom of the upper end of the swing arm and each swing arm being combined with one end of a shock absorber, and another end of the shock absorber having a securing end; each swing arm being combined with a first linkage member, and each first linkage member having a first pivoting end on its upper end and a first assembly end on another end; the swing mechanism further having a second linkage member, one end of the second linkage member attached with a driving element, the driving element having a push-pull bar, a first connecting end and a second connecting end;

the pedal elements being combined with the swing mechanism and each pedal element comprising a balance base and a pedal; each balance base defining a pivoting space below its bottom face and having a first aperture and a connecting aperture on two side walls and a hole at a center position of its upper face; the pedal having a rotating plate on its bottom face and a pivot axle aligned with the hole at its center position, and the pedal having an assembly aperture;

wherein the upper center connecting member and the two swing arms of the swing mechanism are connected to the through aperture of the internal assembly space of the base with a combining aperture on the upper center connecting member, and the securing end of each shock absorber and the first assembly end of each first linkage members are screwed to a respective locking aperture on said sides adjacent the internal assembly space of the base; a second pivoting end of each swing arm is assembled onto the first aperture of each balance base; the first pivoting end of each first linkage member is assembled onto the connecting aperture of each balance base; the swing mechanism further including the second linkage member, the driving element at the other end of each second linkage member utilizing the first connecting end for attachment to a respective pedal; and with the movement of each first linkage member, the driving element of each second linkage member causes each pedal to rotate about a vertical axis when the pedals are moved up and down.

2. The waistline slimming exercise machine as claimed in claim 1, wherein the second linkage member is connected to the shock absorber of the swing mechanism or the first linkage member.

3. The waistline slimming exercise machine as claimed in claim 1, wherein the base has an extended handle at a predetermined position.

4. The waistline slimming exercise machine as claimed in claim 1, wherein the upper center connecting member has a first aperture and one of said swing arms has a tapped aperture, and a screw securing together the first aperture of the upper center connecting member and the tapped aperture of said swing arm.

5. The waistline slimming exercise machine as claimed in claim 1, wherein the first connecting end and the second connecting end are a universal joint or a universal bearing.

6. The waistline slimming exercise machine as claimed in claim 1, wherein the pivot axle of the rotating plate is secured to a protrusion hole of the balance base with a locking member.

7. The waistline slimming exercise machine as claimed in claim 1, wherein the balance base has an indent hole and a corresponding bearing member, and the rotating plate of the pedal is combined with the bearing of the balance base with the pivot axle.

8. The waistline slimming exercise machine as claimed in claim 1, wherein the assembly aperture of the peddle is disposed in a predetermined position on the rotating plate.

9. The waistline slimming exercise machine as claimed in claim 8, wherein the driving element utilizes the first connecting end for attachment onto the assembly aperture of the rotating plate.

10. A waistline slimming exercise machine comprising: a base, a swing mechanism and a pair of pedal elements, wherein:

the base at its center position has a lower center connecting member with an internal assembly space and a through aperture and a locking aperture on two side walls, and a stop disposed on two shorter sides of the base;

the swing mechanism comprising an upper center connecting member and an inclining swing arm disposed on two sides of the upper center connecting member, each swing arm having an assembly end is disposed at the bottom of the upper end of the swing arm and each swing arm being combined with one end of a shock absorber, and another end of the shock absorber having a securing end; each swing arm being combined with a first linkage member, and each first linkage member having a first pivoting end on its upper end and a first assembly end on another end; the first linkage member further including an extended driving arm, one end of the driving arm attached with a driving element, the driving element having a push-pull bar, a first connecting end and a second connecting end;

the pedal elements being combined with the swing mechanism and each pedal element comprising a balance base and a pedal; each balance base defining a pivoting space below its bottom face and having, a first aperture and a tapped aperture on two side walls, and a hole at a center position of its upper face; the pedal having a rotating plate on its bottom face and a pivot axle aligned with the hole at its center position, and the pedal having assembly apertures;

wherein the upper center connecting member and the two swing arms of the swing mechanism are connected to the through aperture of the internal assembly space of the base with a combining aperture, and the securing end and assembly end of each first linkage members are screwed to a respective locking aperture on said sides adjacent the internal assembly space of the base; a second pivoting end of each swing arm assembled onto the first aperture of the pivoting space of each balance base; the first pivoting end of each first linkage member assembled onto the connecting aperture of each balance base; each first linkage member further including the extended driving arm, the driving element at an end of each driving arm utilizing the first connecting end for attachment to the pedals; and with the movement of the first linkage member, the driving element of the driving arm causes the pedals to rotate about a vertical axis when the pedals are moved up and down.

11. The waistline slimming exercise machine as claimed in claim 10, wherein the base has an extended handle at a predetermined position.

12. The waistline slimming exercise machine as claimed in claim 10, wherein the upper center connecting member has a first aperture and one of said swing arms has a tapped aperture, and a screw securing together the first aperture of the upper center connecting member and the tapped aperture of said swing arm.

13. The waistline slimming exercise machine as claimed in claim 10, wherein the first connecting end and the second connecting end are a universal joint or a universal bearing.

14. The waistline slimming exercise machine as claimed in claim 10, wherein the pivot axle of the rotating plate is secured to a protrusion hole of the balance base with a locking member.

15. The waistline slimming exercise machine as claimed in claim 10, wherein each balance base has an indentation hole and a corresponding bearing member, and the rotating plate of the pedals is coupled with the bearing of the balance base with the pivot axle.

16. The waistline slimming exercise machine as claimed in claim 10, wherein the assembly aperture of the peddle is disposed in a predetermined position on the rotating plate.

17. The waistline slimming exercise machine as claimed in claim 16, wherein the driving element utilizes the first connecting end for attachment onto an assembly aperture of the rotating plate.

* * * * *